US005386779A

United States Patent [19]

Baker

[11] Patent Number: 5,386,779

[45] Date of Patent: Feb. 7, 1995

[54] PASSIVE AIR BLAST ATTENUATORS AND VENTILATORS

[75] Inventor: Quentin A. Baker, San Antonio, Tex.

[73] Assignee: Wilfred Baker Engineering, Inc., San Antonio, Tex.

[21] Appl. No.: 930,723

[22] Filed: Aug. 14, 1992

[51] Int. Cl.[6] ..... F42D 5/00; F42B 3/00

[52] U.S. Cl. ..... 102/303; 102/302; 102/331; 428/911

[58] Field of Search ..... 102/302, 303, 331; 60/39.5; 428/911

[56] References Cited

U.S. PATENT DOCUMENTS

| | | | |
|---|---|---|---|
| 721,431 | 2/1903 | Durham | 102/331 |
| 2,807,931 | 10/1957 | Bodine, Jr. | 60/725 X |
| 3,601,985 | 8/1971 | Bauger | 60/725 X |
| 3,713,360 | 1/1973 | Shansey | 86/1 |
| 4,199,936 | 4/1980 | Cowan et al. | 60/725 X |
| 4,519,563 | 5/1985 | Tamura | 60/39.5 X |
| 5,249,534 | 10/1993 | Sacks | 102/303 X |

OTHER PUBLICATIONS

Temet USA, Inc. "PV-Blast Valves", Type PV-6-0-200, Tusa PV-200-89-4.

Luwa Ltd., "Luwa Explosion Protection Valve F", 02.510.0050, BZS No 67-14.

Luwa Ltd., "Explosion Protection Valve K-Pressure Relief Valve K", 61.13.11, BZS No. 75-6.

Quentin A. Baker & John P. Harrell, "Airblast Attenuation and Flow Loss Performance of Passive Attenautors", Twenty-Fifth DoD Explosives Safety Seminar, Anaheim Calif., Aug. 18-20, 1992.

Energy Research and Generation, Inc., "Duocel Aluminum Foam" brochure.

Quentin A. Baker, et al., "Passive Airblast Attenuation Valves for Conventional Weapons", Wilfred Baker Engineering, Report No. WBE-124, Oct. 31, 1989.

*Primary Examiner*—Peter A. Nelson

*Attorney, Agent, or Firm*—Baker & Botts

[57] ABSTRACT

A blast attenuator and ventilator for use in hardened or protective structures or the like that includes within a hollow housing a chamber that is arranged to receive directly the blast effect. Adequate openings for gas flow are provided so that appropriate gas flow for ventilation can occur therethrough.

21 Claims, 4 Drawing Sheets

PASSIVE AIR BLAST ATTENUATORS AND VENTILATORS

NOTICE: The U.S. Government has a paid-up license in this invention and the right in limited circumstances to require the patent owner to license others on reasonable terms as provided for by the terms of Contract No. DACA39-90-R-0015 for the Department of Defense.

TECHNICAL FIELD OF THE INVENTION

This invention relates generally to air blast attenuators that contain no moving parts and are capable of providing ventilation while attenuating air blast.

BACKGROUND INVENTION

Air blast attenuators and ventilators in the past have been constructed in the form of valves that include moving valve members. The structure is arranged so that the valve members move in response to the blast to shut off the attenuator valve. Such valves were primarily designed for use in connection with nuclear blasts and were arranged to provide adequate ventilation when the valve is open. When the valve senses the blast and closes, it will attenuate blast effects where the effects occur over a long period of time. However, such valves have not been effective where the air blast is a result of a detonation of a conventional weapon such as a high explosive bomb. The duration of the air blast is so short in such explosions that the valve mechanisms do not have time to respond and close to attenuate the blast effects.

In response to this difficulty, passive air blast attenuators have been developed and are constructed of items such as nested I-beams, nested angles and zees which provide tortuous flow paths which impede or attenuate the blast effects upon detonation of high explosives. However, such structural arrangements do not provide for adequate ventilation due to the high pressure drop of ventilation gas flowing therethrough.

Accordingly, a substantial amount of work has been done with various arrangements of ported plates in an effort to provide both air blast attenuation and ventilation. Such devices are described in detail in a report entitled "Passive Air Blast Attenuation Valves for Conventional Weapons". This report was prepared for the U.S. Army Engineer Waterways Experiment Station by Quentin A. Baker, et al. The report is Report No. WBE-124, dated Oct. 31, 1989 and was prepared under Contract No. DACA39-89-C-0035.

The ported plate type attenuators described in that report were reasonably effective in attenuating the blast effects while at the same time providing for adequate ventilation. However, it is highly desirable to provide a greater degree of blast attenuation while at the same time providing for better ventilation. The attenuators and ventilators discussed herein are used for preventing insofar as possible any blast effects from passing into a building, occupied either by equipment or personnel, and at the same time being able to provide adequate ventilation. Also, such devices may be utilized in a munitions facility, arsenal, hazardous material manufacturing facility, or chemical processing facility to prevent blast effects from escaping a room where such explosives or flammable materials are stored or manufactured should an accidental explosion occur and also to provide ventilation for the structure.

Our further object is to provide in such attenuators and ventilators effective to attenuate the effects of a blast and providing ventilation that is easily constructed, has no moving parts, is of low cost, and is easily maintained.

SUMMARY OF THE INVENTION

This invention provides an improved air blast attenuator and ventilator that comprises a hollow housing which includes a front wall having a first orifice extending therethrough, a rear wall having a second orifice extending therethrough, and a gas receiving chamber formed in the housing. The chamber includes a baffle wall located to prevent flow directly between the first and second orifices and has an opening aligned with the first orifice permitting flow directly from the first orifice into the chamber.

BRIEF DESCRIPTION OF THE DRAWINGS

The foregoing and additional objects and advantages of the invention will become more apparent as the following detailed description is read in conjunction with the accompanying drawing wherein like-reference characters denote like parts in all views and wherein.

DETAILED DESCRIPTION OF THE PREFERRED EMBODIMENT OF THE INVENTION

Figure 1:
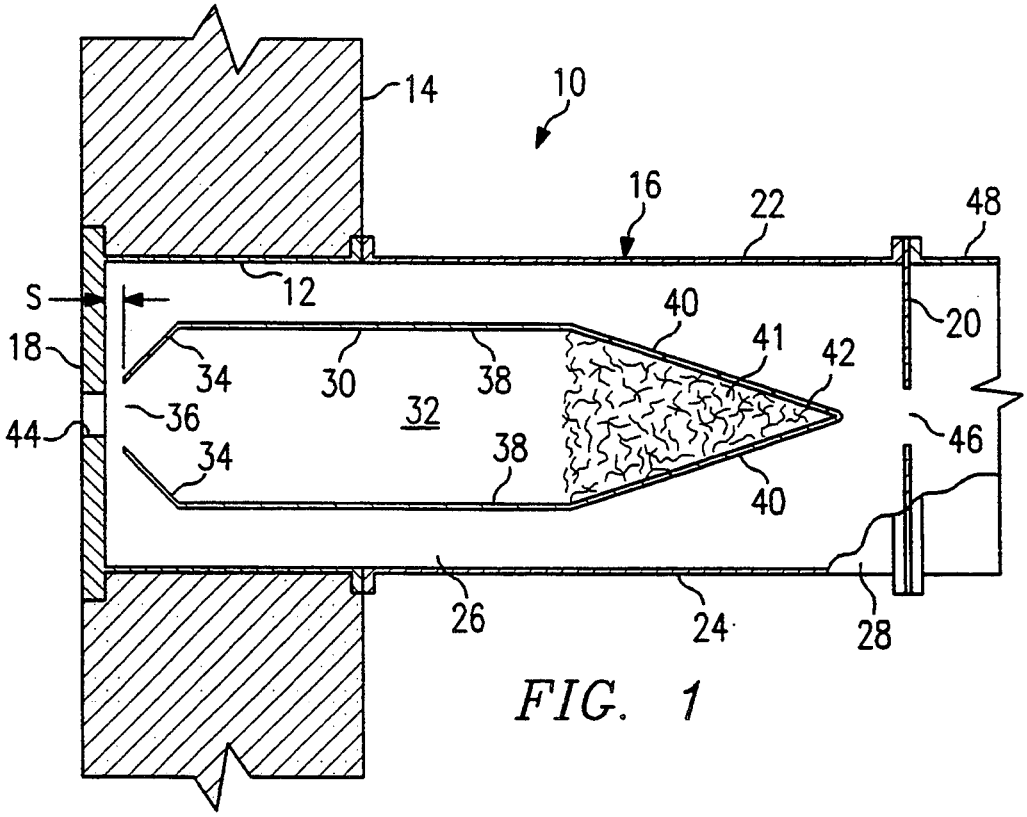
FIG. 1 is a cross-sectional view of an air blast attenuator and ventilator that is constructed in accordance with the invention.

Referring to the drawings and to FIG. 1 in particular, shown therein is a blast attenuator and ventilator assembly that is generally designated by the reference character 10. The assembly 10 is illustrated as being installed in an opening 12 located in a wall 14.

The assembly 10 includes a hollow housing 16 forming a flow passageway that is slightly smaller than the opening 12 extending through the wall 14. The hollow housing 16 includes a front wall 18, a rear wall 20, side walls 22 and 24, a bottom 26 and a top 28. The top 28 is only partially shown in FIG. 1. A chamber wall 30 located within the housing 16 extends between the bottom 26 and the top 28 forming a chamber 32 within the housing 16. The wall 30 includes diverging wall portions 34 located on either side of an entry opening 36, parallel wall portions 38 and converging wall portions 40 which extend to form a point or apex 42 adjacent to the rear wall 20.

The length of the chamber 32 from the opening 36 to the apex 42 depends upon the anticipated longevity of blasts to be attenuated by the assembly 10. For sharp, high explosive bursts, it is anticipated that relatively short chamber 32 would be necessary, while for the attenuation of long blasts such as nuclear blasts, the chamber 32 needs to be substantially longer.

As illustrated in FIG. 1, approximately the rear one-third of the chamber 32 is preferably filled with a steel wool 41 or similar material for absorbing and attenuating a portion of the shock wave which enters the chamber 32 through the opening 36. As an alternative to the steel wool 41, the parallel and converging wall portions 38 and 40 could be lined with an absorbent material such as aluminum foam. One source for aluminum foam is Energy Research and Generation, Inc. of Oakland, Calif. That company manufactures an aluminum foam under the trade name "DUOCEL".

The front plate 18 is provided with an entry port or orifice 44 which is aligned with the opening 36 in the chamber 32. It will also be noted that the orifice 44 is smaller in cross-sectional area than the area of the opening 36. Various relative sizes of openings and orifices were tested, including from about 6 percent of the flow area of the housing 16 to about 31 percent. The optimal size for the orifice 44 is an opening having an area of about 15.6 percent of the cross-sectional area of the flow passageway through the housing 16. The opening 36 preferably has a cross-sectional area of about 22.2 percent of the cross-sectional area of the flow passageway through the housing 16 or, stated another way, should have an area of roughly 5½ to 6 percent greater than that of the orifice 44.

It was also found in the test that various standoffs or distances "S" shown in FIG. 1 provide slightly different results. Preferably, the distance "S" should be about 43 percent of the width of orifice 44.

The rear plate 20 of the housing 16 also includes a flow orifice 46 which permits flow from the orifice 44 through the housing 16 and into a duct 48. The duct 48 forms part of a ventilation system and is illustrated as being attached to the rear end of the housing 16.

In testing the assembly 10 of FIG. 1, explosive charges (not shown) were detonated approximately 48 inches and 77 inches away from the front plate 18 and various pressure measurements were made throughout the assembly 10. In those tests, assembly 10, without the steel wool 41 located in the chamber 32, showed a shock attenuation of about 84.5 percent when the blast was detonated at 48 inches and of about 89 percent when the blast was detonated at 77 inches from the front plate 44. With the steel wool 41 in the chamber 32, the shock attenuation for the 48 inch standoff blast was about 89.5 percent and increased to about 94.3 percent when the blast was detonated at 77 inches.

Figure 2:
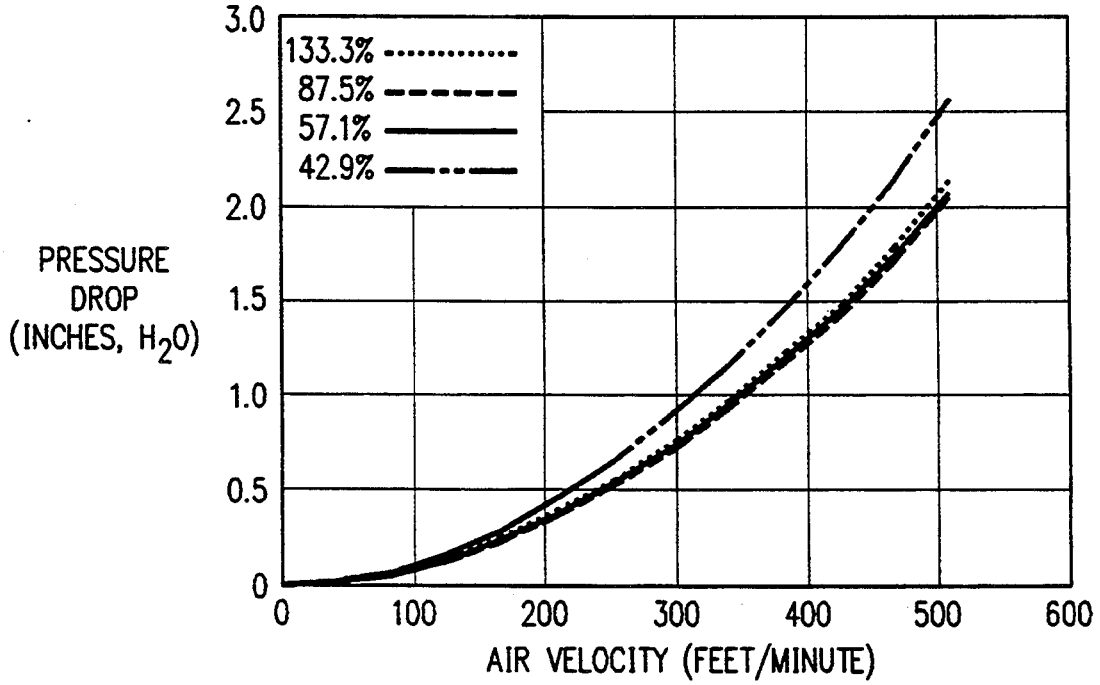
FIG. 2 is a chart illustrating pressure drop versus air velocity through the attenuator and ventilator of FIG. 1.
Figure 3:
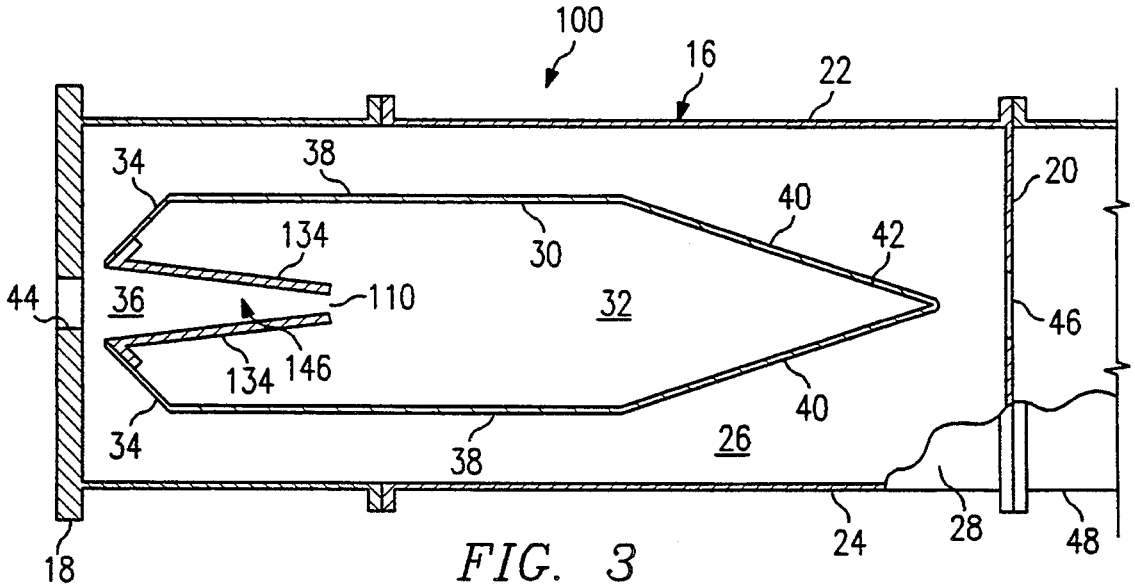
FIG. 3 is a cross-sectional view similar to FIG. 1, but illustrating a modified form of the attenuator and ventilator of FIG. 1.

One of the problems involved in the attenuation and ventilation assembly 10 is the necessity for having a very low pressure drop when air flows through the device during ventilation. FIG. 3 illustrates the pressure drop through the assembly 10 with the chamber 32 positioned so that the opening 36 has a standoff "S" of 42.9, 57.1, 87.5 and 133.3 percent of the width of orifice 44. The curves shown on the graph of FIG. 2 illustrate that flow rates of about 500 feet per minute are attainable through the device with a drop of no more than 2.0 inches of water pressure when the standoff "S" is at least 57.1 percent of the width of orifice 44. However, the pressure shock of attenuation considerations dictate that the preferred form of the apparatus 10 have a standoff "S" of about 42.9 percent of the width of orifice 44; that the orifice 44 be about 15.6 percent of the cross-sectional area of the flow passageway through the housing 16; and that the opening 36 into the chamber 32 be about 22.2 percent of the cross-sectional area of the flow passageway.

In operation, the blast from the explosion enters through the orifice 44 passing directly through the opening 36 into the chamber 30. Much of the blast is reflected directly out through the orifice 44 with some being absorbed by the steel wool 41 (when it is located within the chamber 32). A portion of the blast passes between the wall portions 34 of the chamber wall 30 and around the chamber 32 exiting into the duct 48 through the orifice 46 in rear plate 20. The quantity of the attenuation is as previously described.

While excellent blast attenuation effects are obtained utilizing the apparatus 10, good ventilation characteristics are also attained as evidenced by the curves shown on the graph of FIG. 2. Air flows through the apparatus 10 with a low pressure drop even at high flow velocities of 500 feet/minute.

DESCRIPTION OF THE MODIFICATION OF FIG. 3

In the modified form of the attenuation and ventilation assembly illustrated in FIG. 3 and generally designated by the reference character 100, the housing 16 is constructed as previously described. Also, the chamber wall 30 forming the chamber 32 is constructed as previously described in connection with the assembly 10. However, a modification of the chamber 32 has been made by installing a pair of spaced walls 144 that extend from the bottom 26 to the top 28 of the housing 16 defining interior configuration that includes a nozzle 146 having a reduced size opening 110 that is located between the opening 36 in the chamber 32 and the apex 42. The presence of the nozzle 146 is effective to attenuate shock waves reflecting out of the chamber 32, but apparently causes additional shock waves to be diffracted around the wall portions 34 so that the assembly 100 is less effective than is the preferred assembly 10. The ventilation characteristics remain the same.

DESCRIPTION OF THE EMBODIMENT OF FIG. 4

Figure 4:
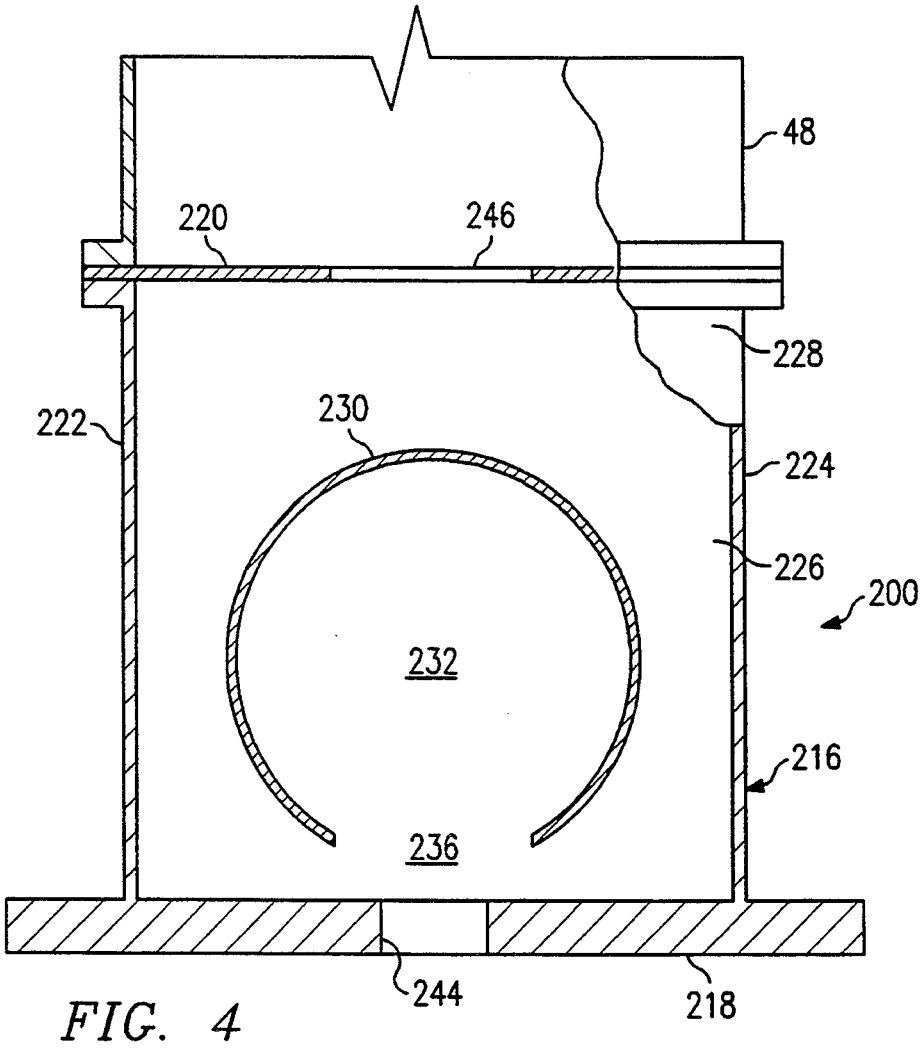
FIG. 4 is a cross-sectional view similar to FIG. 1, but illustrating another embodiment of attenuator and ventilator that is also constructed in accordance with the invention.

FIG. 4 illustrates another embodiment of shock attenuator and ventilator that is effective. The shock attenuator and ventilator assembly illustrated in FIGURE 4 is generally designated by the reference character 200 and includes a housing 216 having a front wall 218 with an orifice 244 extending therethrough, a rear wall 220 with an orifice 246 extending therethrough, side walls 222 and 224, and bottom 226 and top 228.

A chamber wall 230 is circular in cross-section and extends between the bottom 226 and the top 228 and is located within the housing 216. Opening 236 therein is placed adjacent to and in alignment with orifice 244 extending through the front plate 218. The wall 230 forms a chamber 232 therein that is arranged to receive the shock wave as was the chamber 32 in the assembly 10 of FIG. 1.

The apparatus 200 has very low pressure drop and, thus, provides excellent ventilation characteristics. However, as tested and illustrated, the blast attenuation characteristics of the assembly 200 were not quite as good as those of the assembly 10. Nevertheless, the embodiment of FIG. 4, that is, the assembly 200, clearly illustrates apparatus capable of providing effective blast attenuation and ventilation.

DESCRIPTION OF THE EMBODIMENT OF FIG. 5

Figure 5:
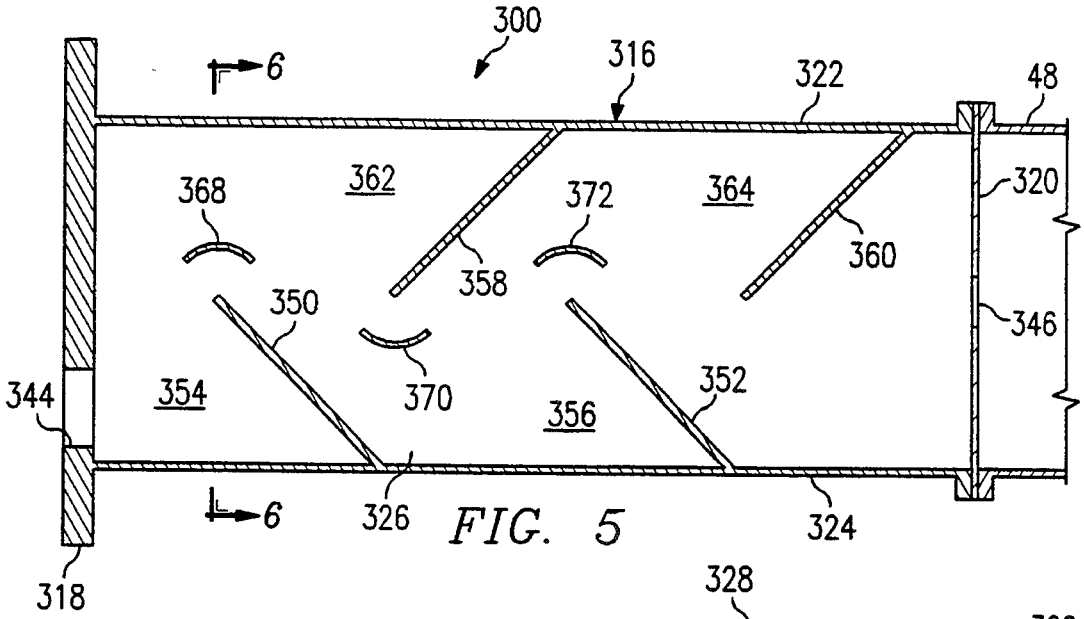
FIG. 5 is a horizontal cross-sectional view of another embodiment of attenuator and ventilator that is also constructed in accordance with the invention.
Figure 6:
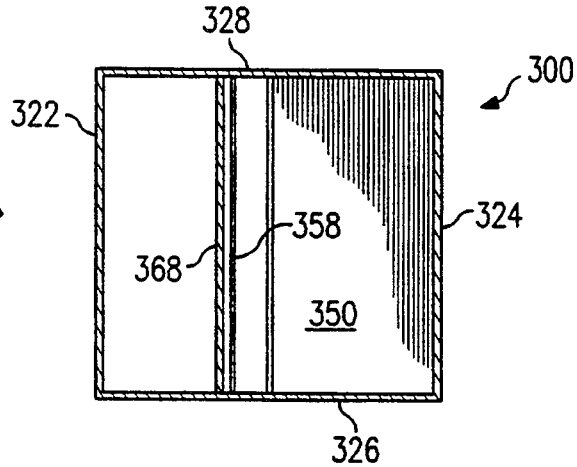
FIG. 6 is a cross-sectional view of the attenuator and ventilator of FIG. 5 taken generally along the lines 6—6 of FIG. 5.

FIGS. 5 and 6 illustrate an attenuator and ventilator assembly 300 that includes a hollow housing 316 having a front wall 318, side walls 322 and 324, top and bottom 326 and 328 and rear wall 320. As illustrated, the housing 316 is connected to the duct 48 described previously.

Chamber forming walls 350 and 352 project inwardly into the housing 316 from the side wall 324 forming chambers 354 and 356. Similarly, chamber forming walls 358 and 360 project inwardly into the housing 316 from the side wall 322 forming chambers 362 and 364. It should also be pointed out that the chamber forming walls 350, 352, 358 and 360 project at an angle to the side walls 324 and 322, respectively, extending relatively toward the front wall 318. Each of the chambers also has an opening facing toward the front wall 318 that is formed by the end of the chamber forming wall and the adjacent side wall. For example, the chamber 354 has an opening 366 that is defined by the end of the chamber forming wall 350 and the adjacent side wall 324. The opening 366 is in alignment with and arranged to receive air blast through a port 344 that extends through the front wall 318.

In addition to the foregoing, the assembly 300 also includes a plurality of turning vanes 368, 370 and 372. It will be noted that the turning vanes are positioned generally adjacent to the ends of the chamber forming walls 350, 358 and 352 and extend between the top 326 and bottom 328. An outlet is provided for gases flowing through the assembly 300 by the opening 346 that is formed in the rear wall 320.

Tests were run on the assembly 300 using various sizes of orifice 344. The size of orifice 344 varied from between 12 and 31 percent of the cross-sectional area of the passageway formed by the housing 316. Also, the tests were run with various clearances between the internal plates. In general, shock attenuation in the assembly 300 was acceptable but not as good as in the preferred assembly 10.

Figure 7:
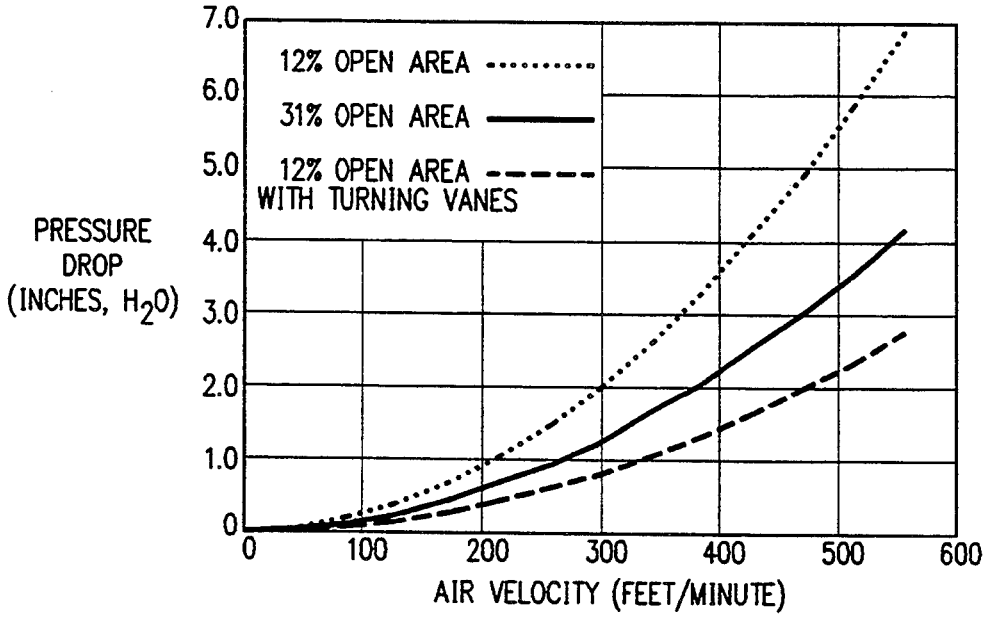
FIG. 7 is a chart illustrating pressure drop versus air velocity through the attenuator and ventilator of FIG. 5.

FIG. 7 is a graph illustrating the pressure drop through the assembly 300 when ventilation air is passed therethrough. The 12 percent clearance curve on the dial shows a pressure drop of about 5.5 inches of water at a gas velocity of 500 feet per minute. As expected, increasing the clearance to 31 percent decreased the pressure drop to about 3.4 inches of water at 500 feet per minute air velocity. However, the most dramatic change in the ventilation characteristics of the assembly 300 occurred when the turning vanes were added. As shown on the graph of FIG. 7, with a 12 percent clearance and the turning vanes installed in the apparatus, the pressure drop at 500 feet per minute air velocity was only 2.2 inches of water.

The attenuation characteristics of the assembly 300 are much better with low clearance, such as the 12 percent clearance illustrated, and with the turning vanes added provides a very low pressure drop to assure good ventilation.

In the operation of the assembly 300, detonation of a high explosive adjacent to the orifice 344 introduces a shock wave into the first chamber 354 wherein a portion of the blast effect is reflected outwardly through the orifice 344. Some of the blast effect escapes through the opening 366 into the second chamber 362. Again, some of the blast effect is reflected from the chamber 362 and spills over into the chamber 356, then into the chamber 364 and then outwardly through the opening 346 in the rear wall 320. The foregoing may be described as a cascading of the blast effect with the reduction or attenuation of such effect serially in the various chambers of the assembly 300. However, when the assembly 300 is used for ventilation, that is when there is no blast, adequate ventilation gas can flow therethrough as evidenced by the low pressure drop even at relatively high air flow velocities.

DESCRIPTION OF THE EMBODIMENT OF FIG. 8

Figure 8:
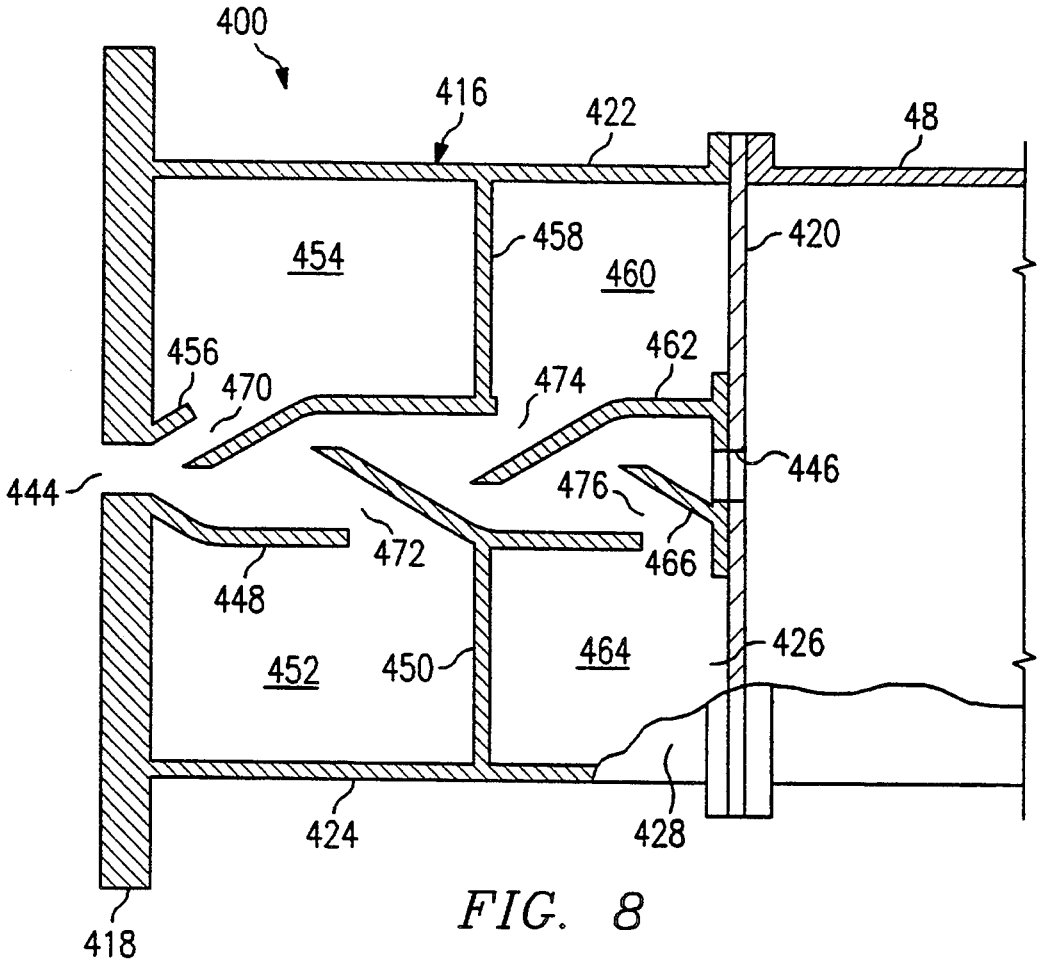
FIG. 8 is a horizontal cross-sectional view similar to FIG. 5 but illustrating another embodiment of attenuator and ventilator that is also constructed in accordance with the invention.

The blast attenuator and ventilator of assembly 400 illustrated in FIG. 8 includes a hollow housing 416 that is connected to the previously described duct 48. The housing 416 includes a front wall 418, side walls 422 and 424, a rear wall 420, and a top and a bottom 428 and 426, respectively. The front wall 418 is provided with an orifice 444 that extends therethrough into the interior of the housing 416 and a rear orifice 446 that extends through the rear wall 420.

The front wall 418, chamber forming walls 448 and 450 and side wall 424 along with the top 428 and bottom 426 combine to form the chamber 452 in the housing 416. Similarly, a chamber 454 is formed by chamber forming walls 456 and 458. An additional chamber 460 is formed by the wall 458, side wall 422 and the rear wall 420 and a chamber forming wall 462. A fourth chamber 464 is formed by the side wall 424, a chamber forming wall 450, a chamber forming wall 466 and a rear wall 420.

In addition to the foregoing, the chamber forming walls 456 and 458 cooperate to form an opening 470 that is positioned in alignment with the orifice 444 and arranged to receive a portion of the blast effect flowing therethrough. Similarly, an opening 472 that extends into the chamber 452 is formed by the chamber forming wall 448 and 450. A third opening 474 is formed by chamber forming walls 458 and 462 and leads into the chamber 460. An opening 476 is formed by the chamber forming walls 450 and 456 and provides entry for the gas into the chamber 464. Various areas of openings 470, 472, 474 and 476 should provide excellent blast attenuation effects based upon the results from testing one specific opening size.

Figure 9:
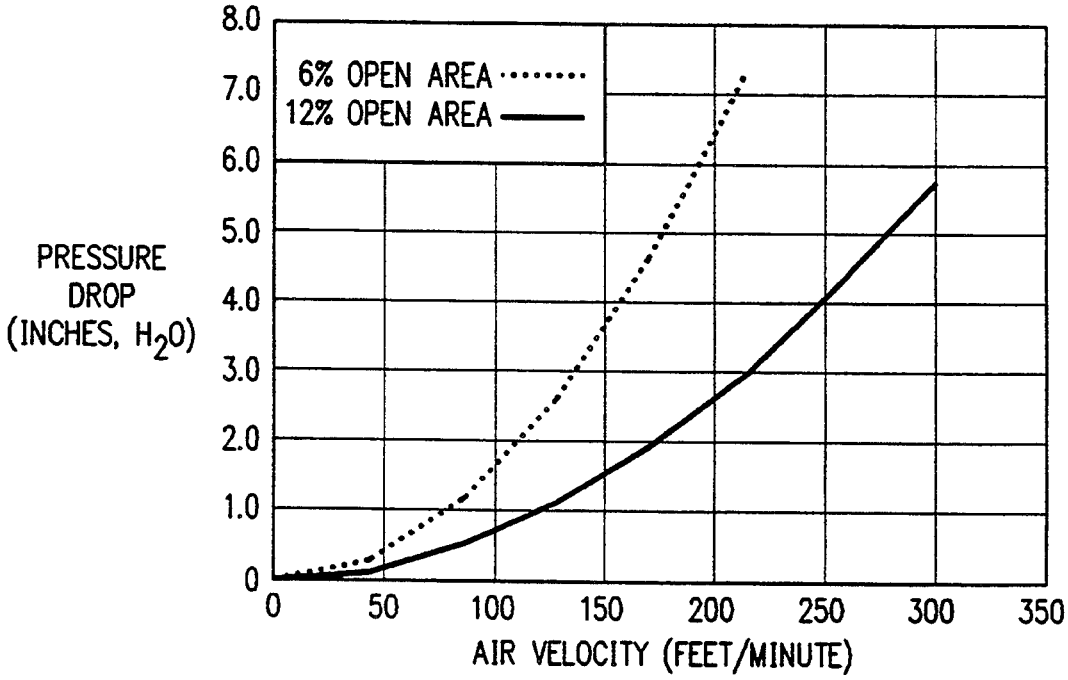
FIG. 9 is a chart illustrating pressure drop versus air velocity through the attenuator and ventilator of FIG. 8.

Substantially different results were received when testing assembly 400 for pressure drop when the areas of the openings were changed from 6 percent to 12 percent of the cross-sectional area of the flow passageway through the housing 416. FIG. 9 illustrates the results of the ventilation test for those two opening sizes. The 12 percent open area produced substantially better ventilation results.

In operation, a blast is detonated adjacent to the orifice 444 and the effects thereof flow through the opening 470 into the chamber 454. A portion of the blast effect flows through the opening 472 into the chamber 452 and again, a portion is reflected and passes through the opening 474 into the chamber 460. Attenuation of the blast effect is obtained as the gases produced thereby flow through each of the openings into the various chambers. Finally, any blast effect, not totally attenuated, passes through the orifice 446 in the rear plate 420 and outwardly through duct 448. The attenuation of the blast effect by the assembly 400 is excellent. As can be seen from viewing FIG. 9, the pressure drop through the assembly 400, even with the 12 percent open area, was somewhat higher than in the previously described assemblies.

Each of the embodiments described in detail hereinbefore provide an effective means for attenuating the effect of blasts produced by high explosive detonation. Also, each of the assemblies provides for flow of adequate ventilating air through the assemblies.

The foregoing embodiments are presented by way of the example only and it will be understood that many changes and modifications can be made thereto without departing from the spirit or scope of the invention.

What is claimed is:

1. An air blast attenuator and ventilator comprising a hollow housing defining a flow passageway including:
   - a front wall having a first orifice extending therethrough;
   - a rear wall having a second orifice extending therethrough; and
   - chamber forming means located in said housing for forming a gas receiving chamber disposed between said front wall and said rear wall, said chamber forming means including a baffle wall located to prevent flow directly between said first and second orifices, said baffle wall having an opening aligned with said first orifice permitting flow directly from said first orifice into said chamber.

2. The attenuator and ventilator of claim 1 and also including at least two of said gas receiving chambers formed within said housing with said respective openings in cascade arrangement.

3. The attenuator and ventilator of claim 1 wherein the area of said first orifice is between 6% and 31% of the area of said flow passageway.

4. The attenuator and ventilator of claim 2 wherein the area of said first orifice is between 6% and 31% of the area of said flow passageway.

5. The attenuator and ventilator of claim 4 wherein the area of said first orifice is about 31% of the area of said flow passageway.

6. The attenuator and ventilator of claim 1 wherein said baffle wall defines a circle.

7. The attenuator and ventilator of claim 1 wherein said baffle wall extends between said front wall and said rear wall providing an elongated chamber.

8. The attenuator and ventilator of claim 7 wherein said baffle wall includes first and second wall portions converging adjacent to said rear wall.

9. The attenuator and ventilator of claim 8 wherein said wall portions diverge from said opening toward said rear wall before converging.

10. The attenuator and ventilator of claim 1 wherein said opening is larger than said first orifice.

11. The attenuator and ventilator of claim 6 wherein said opening is larger than said first orifice.

12. The attenuator and ventilator of claim 9 wherein said opening is larger than said first orifice.

13. The attenuator and ventilator of claim 8 and also including an air blast attenuating material lining the interior of the converging wall portions.

14. The attenuator and ventilator of claim 13 wherein said material is steel wool.

15. The attenuator and ventilator of claim 13 wherein said material is an aluminum foam.

16. An air blast attenuator and ventilator comprising a hollow housing defining a flow passageway including:
   - a front wall having a first orifice extending therethrough;
   - a rear wall having a second orifice extending therethrough;
   - a top and a bottom connected to said front and rear walls;
   - spaced, first and second side walls, connected to said top and bottom, and front and rear walls;
   - a first baffle wall connected to said first side wall and to said top and bottom and having a free end extending at an angle relative said first side wall, said first baffle wall located to prevent direct flow between said first and second orifices; and
   - a second baffle wall connected to said second side wall and to said top and bottom between said first baffle wall and said rear wall and extending at an angle relative to said second side wall toward said first baffle member and located to prevent direct flow from said free end of said first baffle wall to said second orifice.

17. The attenuator and ventilator of claim 16 and also including a turning vane located proximate each free end of said baffle walls to direct flow around said ends.

18. The attenuator and ventilator of claim 16 wherein the area of said first orifice is between 6% and 31% of the area of said flow passageway.

19. The attenuator and ventilator of claim 18 wherein the area of said first orifice is about 31% of the area of said flow passageway.

20. The attenuator and ventilator of claim 19 wherein the area of said opening is about 22 percent of the area of said flow passageway.

21. The attenuator and ventilator of claim 20 wherein said opening is located about 42.9 percent of the width of said orifice from said orifice.

* * * * *